US007744743B2

(12) United States Patent
McCoy et al.

(10) Patent No.: US 7,744,743 B2
(45) Date of Patent: Jun. 29, 2010

(54) PROCESS FOR UPGRADING TAR

(75) Inventors: James N. McCoy, Houston, TX (US); Paul F. Keusenkothen, Houston, TX (US); Alok Srivastava, Singapore (SG)

(73) Assignee: Exxonmobil Chemical Patents Inc., Houston, TX (US)

( * ) Notice: Subject to any disclaimer, the term of this patent is extended or adjusted under 35 U.S.C. 154(b) by 262 days.

(21) Appl. No.: 11/589,453

(22) Filed: Oct. 30, 2006

(65) Prior Publication Data

US 2008/0099371 A1 May 1, 2008

(51) Int. Cl.
*C10G 3/00* (2006.01)
*C10G 1/00* (2006.01)

(52) U.S. Cl. ..... 208/86; 208/45; 208/87; 208/96; 208/131; 208/309; 210/634; 210/804; 422/189

(58) Field of Classification Search ..... 208/45, 208/86, 87, 96, 131, 309; 210/634, 804; 422/189

See application file for complete search history.

(56) References Cited

U.S. PATENT DOCUMENTS

| | | | | |
|---|---|---|---|---|
| 2,343,192 | A | | 2/1942 | Kuhn |
| 2,462,593 | A | | 2/1949 | Batchelder |
| 2,695,264 | A | | 12/1950 | Taff et al. |
| 3,060,116 | A | | 11/1959 | Hardin, Jr. et al. |
| 3,622,502 | A | | 11/1971 | Mason et al. |
| 3,691,058 | A | | 9/1972 | Hamner et al. |
| 3,707,459 | A | | 12/1972 | Mason et al. |
| 3,923,921 | A | | 12/1975 | Kohfeldt |
| 3,998,726 | A | * | 12/1976 | Bunas et al. ..... 208/309 |
| 4,150,716 | A | | 4/1979 | Ozaki et al. |
| 4,207,168 | A | | 6/1980 | Simone |
| 4,264,334 | A | | 4/1981 | Durand et al. |
| 4,279,734 | A | | 7/1981 | Gwyn |
| 4,446,002 | A | | 5/1984 | Siegmund |
| 4,795,551 | A | | 1/1989 | Hamilton et al. |
| 5,215,649 | A | | 6/1993 | Grenoble et al. |
| 5,443,715 | A | | 8/1995 | Grenoble et al. |
| 5,976,361 | A | | 11/1999 | Hood et al. |
| 6,183,626 | B1 | | 2/2001 | Lenglet et al. |

FOREIGN PATENT DOCUMENTS

| | | |
|---|---|---|
| DE | 4308507 | 3/1993 |

(Continued)

*Primary Examiner*—Glenn Caldarola
*Assistant Examiner*—Prem C. Singh

(57) ABSTRACT

A feedstream comprising tar is fed to a solvent deasphalter wherein it is contacted with a deasphalting solvent or fluid to produce a composition comprising a mixture or slurry of solvent containing a soluble portion of the tar, and a heavy tar fraction comprising the insoluble portion of the tar. These fractions may be separated in the deasphalter apparatus, such as by gravity settling wherein the heavy tar fraction is taken off as bottoms, and the solvent-soluble fraction taken as overflow or overheads with the solvent. The overflow or overheads is sent to a solvent recovery unit, such as a distillation apparatus, wherein solvent is recovered as overheads and a deasphalted tar fraction is taken off as a sidestream or bottoms. The solvent or a portion thereof, recovered as overheads, may be then be recycled to the solvent deasphalter, or in a preferred embodiment, at least a portion of the solvent is steam cracked to produce a product comprising light olefins.

19 Claims, 2 Drawing Sheets

FOREIGN PATENT DOCUMENTS

| | | |
|---|---|---|
| EP | 0 031 609 | 8/2001 |
| GB | 1 032 690 | 6/1966 |
| JP | 58149991 | 3/1982 |
| WO | 91/13951 | 9/1991 |
| WO | 91/17230 | 11/1991 |
| WO | 93/12200 | 6/1993 |

* cited by examiner

PROCESS FOR UPGRADING TAR

FIELD OF THE INVENTION

The invention relates to upgrading of tar (pyrolysis fuel oil) to produce deasphalted tar from steam cracked tar.

BACKGROUND OF THE INVENTION

Stream cracking, also referred to as pyrolysis, has long been used to crack various hydrocarbon feedstocks into olefins, preferably light olefins such as ethylene, propylene, and butenes. Conventional steam cracking utilizes a pyrolysis furnace wherein the feedstock, typically comprising crude or a fraction thereof optionally desalted, is heated sufficiently to cause thermal decomposition of the larger molecules. Among the valuable and desirable products include light olefins such as ethylene, propylene, and butylenes. The pyrolysis process, however, also produces molecules that tend to combine to form high molecular weight materials known as steam cracked tar or steam cracker tar, hereinafter referred to as "SCT" or simply "tar". SCT is also known in the art as "pyrolysis fuel oil". These are among the least valuable products obtained from the effluent of a pyrolysis furnace. In general, feedstocks containing higher boiling materials ("heavy feeds") tend to produce greater quantities of SCT.

SCT is among the least desirable of the products of pyrolysis since it finds few uses. SCT tends to be incompatible with other "virgin" (meaning it has not undergone any hydrocarbon conversion process such as FCC or steam cracking) products of the refinery pipestill upstream from the steam cracker. At least one reason for such incompatibility is the presence of asphaltenes. Asphaltenes are very high in molecular weight and precipitate out when blended in even small amounts into other materials, such as fuel oil streams.

One way to avoid production of SCT is to limit conversion of the pyrolysis feed, but this also reduces the amount of valuable products such as light olefins. Another solution is to "flux" or dilute SCT with stocks that do not contain asphaltenes, but this also requires the use of products that find higher economic value in other uses.

Many low-volume uses of SCT have been devised. For instance, U.S. Pat. No. 4,207,168 teaches making needle coke from pyrolysis fuel oil by separating quinoline insolubles and asphaltenes from the fuel oil and subjecting the remaining portion to coking In U.S. Pat. No. 4,207,168, a pyrolysis fuel oil is contacted with a promoter liquid to separate quinoline insolubles and asphaltenes from the fuel oil. The fraction free of quinoline insolubles and having a reduced content of asphaltenes is optionally subjected to coking to produce needle coke or employed directly for the production of carbon black.

In U.S. Pat. No. 4,446,002, the precipitation of sediment in unconverted residuum obtained from a virgin residuum conversion process is taught to be suppressed by blending the unconverted residuum with an effective amount of a virgin residuum having an asphaltene content of at least about 8 wt % of the virgin residuum at a temperature sufficient to maintain both residuum components at a viscosity of no greater than about 100 cSt (centistokes) during blending. Virgin residuum is the bottoms product of the atmospheric distillation of petroleum crude oil at temperatures of about 357 to 385° C.

In U.S. Pat. No. 5,443,715, steam cracked tar is upgraded by mixing with a "hydrogen donor", preferably hydrotreated steam cracked tar, at or downstream of quenching of the effluent of a gas oil steam cracker furnace. In this regard, see also U.S. Pat. Nos. 5,215,649; and 3,707,459; and WO 9117230.

Other references of interest include U.S. Pat. Nos. 3,622,502; 3,691,058; 4,264,334; WO 91/13951; DE 4308507; and JP 58-149991.

Despite these advances, there remains a problem that SCT continues to be generated in amounts beyond the capacity of current technology to be efficiently utilized. Thus, significant amounts of SCT must be disposed of by adding to fuel oil pools or simply local combustion to generate, for example, steam. However, steam cracker tar, even relatively low asphaltene steam cracker tar, is generally incompatible with fuel oil pools such as Bunker C fuel oil. Onsite tar burning in site boilers is then preferred to avoid tar separation investment, but tighter emission regulations increasingly limit the amount that can be burned for this purpose.

The present inventors have discovered a process for comprising deasphalting tar that is conveniently integrated with one or more pyrolysis furnaces, the process providing an efficient method of upgrading tar.

SUMMARY OF THE INVENTION

The invention relates to upgrading of tar (pyrolysis fuel oil) by use of solvent deasphalter to deasphalt steam cracker tar, and to a system for producing deasphalted tar.

In a preferred process of the invention, the fluid (or solvent) used in the deasphalter is selected from feedstreams to a pyrolysis furnace, such as butanes, LVN (light virgin naphtha), FRN (full range naphtha), HVN (heavy virgin naphtha), Raffinate, and FNG (fuel natural gas).

In more preferred embodiments, the fluid (or solvent) used in the process is then used as a feedstream to a pyrolysis furnace, wherein it is cracked to produced a product comprising light olefins.

It is an object of the invention to upgrade tar fractions to more valuable end products. It is further an object, in embodiments, to provide an integrated system which upgrades tar fractions and provides feed for a pyrolysis furnace, preferably wherein the product of the pyroylsis furnace comprises light olefins.

These and other objects, features, and advantages will become apparent as reference is made to the following detailed description, preferred embodiments, examples, and appended claims.

BRIEF DESCRIPTION OF THE DRAWINGS

In the accompanying drawings, like reference numerals are used to denote like parts throughout the several views.

DETAILED DESCRIPTION

Figure 1:
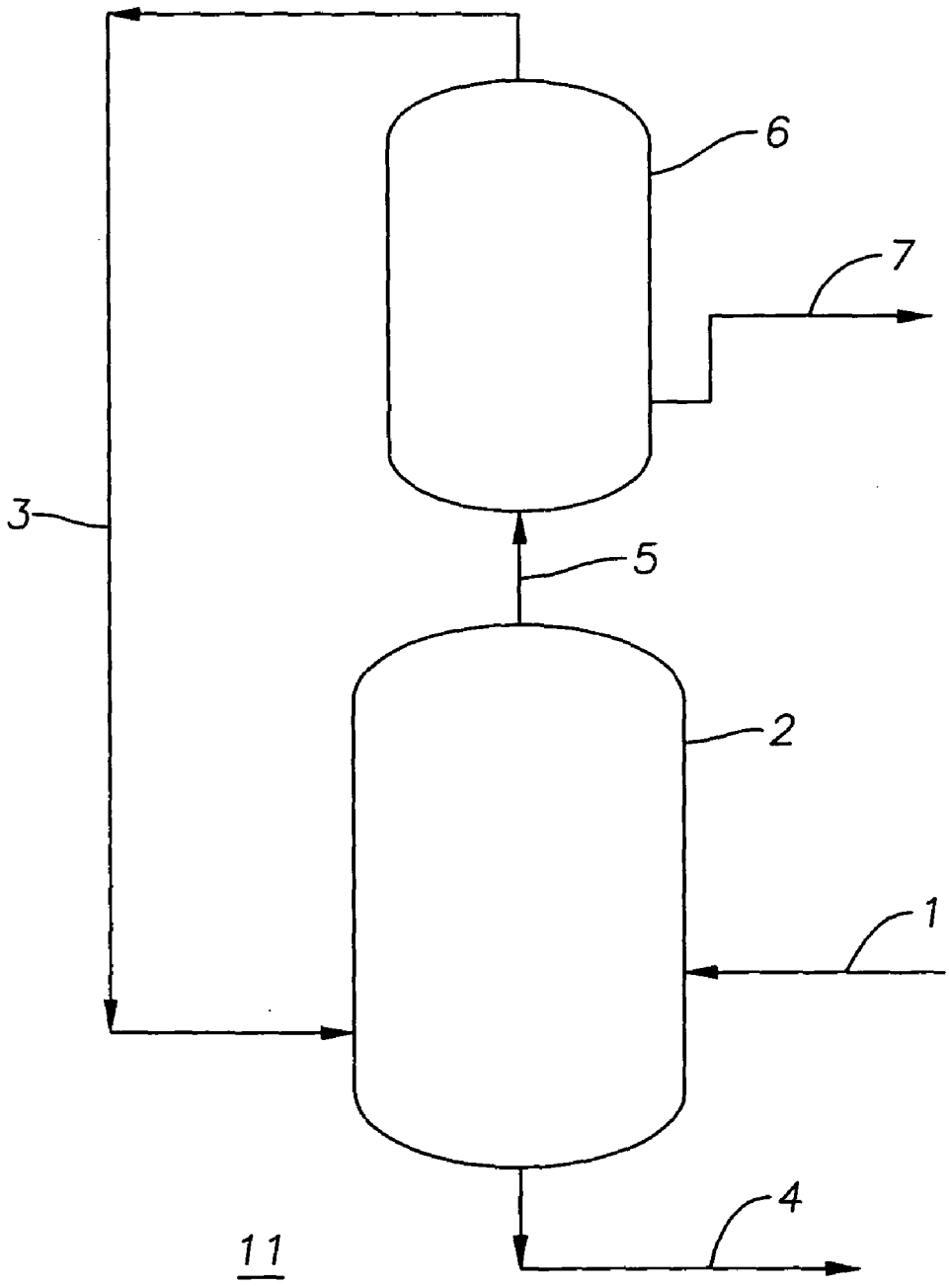
FIG. 1 is a generalized process flow diagram illustrating the present invention.

According to the invention, a feedstream comprising tar is feed to a solvent deasphalter wherein it is contacted with a deasphalting fluid or solvent (the terms are used interchangeably herein) to produce a composition comprising a mixture or slurry of solvent containing a soluble portion of the tar, and a heavy tar fraction comprising the insoluble portion of the tar. These fractions may be separated in the deasphalter apparatus, such as by gravity settling, wherein the heavy tar fraction is taken off as bottoms and the solvent-soluble fraction taken as overflow or overheads with the solvent. The overflow or overheads is sent to a solvent recovery unit, such as a distillation apparatus, wherein solvent is recovered as overheads and a deasphalted tar fraction is taken off as a sidestream or bottoms from the solvent recovery unit. The solvent or a portion thereof, recovered as overheads, may be then be recycled to the solvent deasphalter, or in a preferred embodiment described below, at least a portion of the solvent is sent to one or more steam crackers and steam cracked to produce a product comprising light olefins (ethylene, propylene, butenes, and the like).

In a preferred embodiment the solvent used in the deasphalter is advantageously selected from feedstreams which are amenable to both steam cracking (even more preferably, wherein the product of steam cracking comprises light olefins) and deasphalting of tar. It is particularly advantageous that this embodiment, as well as other embodiments of the invention, be integrated with a pyrolysis furnace, so that the solvent used for deasphalting is taken as a slipstream from the feedstream to the pyrolysis furnace and, subsequent to the two steps comprising: (a) deasphalting the tar and then (b) recovery in the solvent recovery facility, at least a portion of the solvent from the solvent recovery facility is then sent to the pyrolysis furnace to be steam cracked (optionally rejoining the feedstream from which it was derived as a slipstream prior to reaching the pyrolysis furnace). Such an integrated system may or may not be the same system from which the tar is derived as a product, usually from the first or primary fractionator downstream from the convection section of the pyrolysis furnace.

It should be noted that the terms thermal pyrolysis unit, pyrolysis unit, steam cracker and steamcracker are used synonymously herein; all refer to what is conventionally known as a steam cracker (even though steam is optional).

Preferred feeds will include virgin light paraffinic feeds that completely boil at temperatures low enough to separate the solvent from deasphalted tar using conventional distillation (i.e., atmospheric distillation such as using an atmospheric pipestill or APS). Specific preferred solvents useful in the present invention in the deasphalting step and which are also steam cracker feeds include at least one of butanes, light virgin naphtha (LVN), full range naphtha (FRN), heavy virgin naphtha (HVN), Raffinate, and fuel natural gas (FNG). These terms are all per se well known in the art. Mixtures of these materials may be used and also fluids which contain these fluids in addition to other materials may be used.

The feedstream to the deasphalter comprises tar. "Tar" or steam cracker tar (SCT) as used herein is also referred to in the art as "pyrolysis fuel oil". The terms will be used interchangeably herein. The tar will typically be obtained from the first fractionator downstream from a steam cracker (pyrolysis furnace) as the bottoms product of the fractionator, nominally having a boiling point of 550° F.+ (288° C.+) and higher.

In a preferred embodiment, SCT is obtained as a product of a pyrolysis furnace wherein additional products include a vapor phase including ethylene, propylene, butenes, and a liquid phase comprising C5+ species, having a liquid product distilled in a primary fractionation step to yield an overheads comprising steam-cracked naphtha fraction (e.g., C5-C10 species) and steam cracked gas oil (SCGO) fraction (i.e., a boiling range of about 400 to 550° F., e.g., C10-C15/C17 species), and a bottoms fraction comprising SCT and having a boiling range above about 550° F., e.g., C15/C17+ species).

The SCT is mixed with the solvent and deasphalted in the deasphalter. Solvent deasphalting is a per se known process whereby asphaltenes are removed from a substance by solvent extraction. The products of the deasphalting step include a deasphalted tar product, which is obtained in the fluid-soluble fraction, and an asphaltene or "heavy tar" fraction.

The term "asphaltene" is well-known in the art and generally refers to the material obtainable from crude oil and having an initial boiling point above 1200° F. (i.e., 1200° F.+ or 650° C.+ material) and which is insoluble in straight chain alkanes such as hexane and heptanes, i.e., paraffinic solvents. Asphaltenes are high molecular weight, complex aromatic ring structures and may exist as colloidal dispersions. They are soluble in aromatic solvents like xylene and toluene. Asphaltene content can be measured by various techniques known to those of skill in the art, e.g., ASTM D3279.

It is generally not necessary to recover a fraction free of all asphaltenes. An asphaltene content in the deasphalted tar portion recovered in the solvent recovery facilities, discussed below, of from about nil asphaltenes to about 300 ppm is preferred.

In preferred embodiments the solvent in the deasphalter is set at a fixed ratio for the deasphalter as a function of the solvent selected. For a given solvent, the amount used relative to the amount of tar is preferably set so that there is a high enough asphaltene removal to allow the deasphalted product to be completely compatible when blended into fuel oil pool, e.g., such as preferably at least 60 wt % of the initial tar feed into the deasphalter, preferably greater than 65 wt %, more preferably at least 70 wt %.

Operating conditions of the deasphalter may be determined by one of ordinary skill in the art in possession of the present disclosure and will depend on several factors, particularly the deasphalting solvent chosen and to a lesser extent the composition of the tar. Asphaltenes typically can be separated from the tar at a temperature in the order of from 50° C. to about 300° C. The separation can be effected at atmospheric pressure or higher pressures can be employed. The typical solvent deasphalter operates with gravity difference separation techniques, such as where the fluid-soluble fraction of the tar is recovered as an overflow or overhead and fraction containing an increased amount of asphaltenes separated from the tar is obtained as underflow or bottoms product.

The fluid-soluble fraction taken as overhead or overflow is sent to a fluid recovery facility where essentially pure fluid (solvent) is taken overhead and a deasphalted tar product is taken as sidestream or bottoms product. The fluid recovery facility may be a conventional pipestill or in a preferred embodiment, as discussed elsewhere herein, for instance with respect to FIG. 2, below, the vacuum pipestill may be equipped with an annular entrainment ring. The overhead may be recycled from the fluid recovery unit to the deasphalter step or in a preferred embodiment sent to the steam cracker furnace, or a combination thereof.

In general the operating conditions of such a pyrolysis furnace, which may be a typical pyrolysis furnace such as known per se in the art, can be determined by one of ordinary skill in the art in possession of the present disclosure without more than routine experimentation. Typical conditions will include a radiant outlet temperature of between 760-880° C., a cracking residence time period of 0.01 to 1 sec, and a steam dilution of 0.2 to 4.0 kg steam per kg hydrocarbon.

It is preferred that the furnace have a vapor/liquid separation device (sometimes referred to as flash pot or flash drum) integrated therewith, such as disclosed and described in U.S. Patent applications 2004/0004022; 20040004027; 2004/0004028; 2005/0209495; 2005/0261530; 2005/0261531; 2005/0261532; 2005/0261533; 2005/0261534; 2005/0261535; 2005/0261536; 2005/0261537; and 2005/0261538. Another preferred vapor/liquid separation device is described in U.S. Pat. No. 6,632,351. In a preferred embodiment using a vapor/liquid separation device ("the device"), the composition of the vapor phase leaving the device is substantially the same as the composition of the vapor phase entering the device, and likewise the composition of the liquid phase leaving the flash drum is substantially the same as the composition of the liquid phase entering the device, i.e., the separation in the vapor/liquid separation device consists essentially of a physical separation of the two phases entering the drum.

In embodiments using a vapor/liquid separation device integrated with the pyrolysis furnace, a feedstream is provided to the inlet of a convection section of a pyrolysis unit, wherein it is heated so that at least a portion of the feedstream is in the vapor phase. Steam is optionally but preferably added in this section and mixed with the feedstream. The heated feedstream with optional steam and comprising a vapor phase and a liquid phase is then flashed in the vapor/liquid separation device to drop out the heaviest fraction (e.g., asphaltenes). In still more preferred embodiments the vapor/liquid separation device integrated with the pyrolysis furnace operates at a temperature of from about 800° F. to about 850° F. (about 425° C. to about 455° C.). The overheads from the vapor/liquid separation device are then introduced via crossover piping into the radiant section where the overheads are quickly heated, such as at pressures ranging from about 10 to 30 psig, to a severe hydrocarbon cracking temperature, such as in the range of from about 1450 to 1550° F., to provide cracking of the feedstream.

In the embodiment of the invention wherein the deasphalting system is integrated with one or more pyrolysis furnaces, the feed comprising the solvent used to deasphalt tar according to the invention, such as a light virgin paraffinic feed or more preferably one of the preferred solvent/feeds discussed elsewhere herein, which may also be mixed, prior to introduction to the pyrolysis furnace, with crude or fraction thereof, is converted in the pyrolysis furnace, optionally having a vapor/liquid separator as described above, at an elevated temperature to cracked products. The hot cracked gas may be quenched or passed at substantially the elevated temperature of the furnace into a pyrolysis fractionating column, also referred to as the first or primary fractionator or fractionating column. Within the fractionating column, the cracked products are separated into a plurality of fractionation streams including $H_2$, methane, higher alkanes, and olefins such as ethylene, propylene, butenes, which are recovered from the fractionating column as overheads or sidestreams, along with a bottoms product comprising tar and steam cracked gas oil (SCGO). Typically this residue material will have a boiling point above about 400° F. (It should be noted that boiling points given herein are to be taken at atmospheric conditions unless another pressure condition is indicated). This material is sent to the solvent deasphalter (through conduit 1 in both FIGS. 1 and 2, discussed below) according to the present invention.

In addition to the fluids discussed above as preferable for the process of deasphalting and then steam cracked, the fluids may be mixed with additional feedstreams prior to being sent to the pyrolysis furnace. Such additional feedstreams may comprise crude (such as a high sulfur containing virgin crude rich in polycyclic aromatics which has been desalted), or a crude fraction thereof (such as may be obtained from an atmospheric pipestill (APS) or vacuum pipestill (VPS) of a type per se well-known in the art, or typically a combination of APS followed by VPS treatment of the APS bottoms).

Crude, as used herein, means whole crude oil as it issues from a wellhead, optionally including a step of desalting and/or other steps as may be necessary to render it acceptable for conventional distillation in a refinery. Crude as used herein is presumed to contain resid unless otherwise specified. The crude and/or fraction thereof are optionally but preferably desalted prior to being provided to the pyrolysis furnace.

The deasphalted product obtained according to the process of the invention, which preferably comprises at least 50 wt % of the bottoms from the primary fractionator of the pyrolysis furnace, more preferably greater than 60 wt %, still more preferably at least 70 wt %, may be blended into any Bunker C fuel oil pool, or a lighter fuel, without compatibility problems. Numerous other dispositions of the deasphalted product are contemplated, such as to be blended with lighter fuel oil or as feed to hydrocracker to produce diesel. The term "lighter" in this regard means lower density.

The heavy tar product, which is the bottoms product of the deasphalter, may in embodiments be processed in a partial oxidation unit (POX) or coker unit (such as described more fully below) or may be burned locally in boilers.

Various embodiments of the present invention will now be illustrated by reference to the figures. It will be understood by those of skill in the art that these embodiments are intended only as illustrations and not intended to be limiting. Numerous variations will be immediately apparent to the skill artisan in possession of the present disclosure.

FIG. 1 is a simplified schematic flow diagram of a first embodiment of the invention, showing a system 11 useful in a process for deasphalting tar. In FIG. 1, a feedstream comprising tar is provided through conduit 1 to the solvent deasphalter 2 from the primary fractionator downstream of a pyrolysis furnace.

The pyrolysis furnace along with the associated primary fractionator is not shown in the drawing but may be conventional or preferably the pyrolysis furnace has an integrated vapor/liquid separator, as described in U.S. Patent applications 2004/0004022; 20040004027; 2004/0004028; 2005/0209495; 2005/0261530; 2005/0261531; 2005/0261532; 2005/0261533; 2005/0261534; 2005/0261535; 2005/0261536; 2005/0261537; and 2005/0261538; and in U.S. Pat. No. 6,632,351.

The feedstream provided through 1 is typically the bottoms product of the primary fractionator of a pyrolysis furnace, having a boiling point of 550° F.+ and including a fraction having a boiling point of 1000° F.+.

In the solvent deasphalter 2 the feedstream comprising tar is contacted with a fluid or solvent according to the present invention, which is provided by conduit 3. The fluid is mixed with the feedstream comprising tar to provide, in the deasphalting apparatus 2, an asphaltene-depleted tar fraction, which is relatively soluble in the fluid, and an asphaltene-enriched portion, which is relatively insoluble in the fluid. The amount of fluid to be mixed with the feedstream may be determined by one of ordinary skill in the art in possession of the present disclosure without more than routine experimentation. As a useful guideline, about 10 parts fluid can be mixed with about 1 part tar. It is preferred however that the solvent be chosen and mixed in proportions such that at least 60 wt % of the tar fraction ends up in the deasphalted tar fraction taken off in the solvent recovery facility 6, discussed in detail below. Other preferred wt % fractions have been discussed elsewhere herein. In preferred embodiments, an object of the invention is to chose the solvent and the proportions of mixture with tar so that all of the deasphalted tar fraction taken off in the solvent recovery facility 6 mixed in any and all proportions with fuel oil pools such as Bunker C fuel oil or lighter fuel oil pools.

After mixing the resulting fractions, one being the fluid fraction with soluble tar portion and the other being the asphaltene-enriched fraction, may be separated by gravity, so that the asphaltene-enriched fraction or "heavy tar" fraction, generally having a boiling point of 1000° F.+, may be taken off at bottoms through conduit 4 and the fluid soluble fraction taken as overheads or overflow through conduit 5. A portion or all of the bottoms product may be sent to one or more of a partial oxidation unit (POX) or coker unit, discussed herein below, or mixed with fuel oil pool (e.g., Bunker fuel oil) or burned locally, and the overflow or overheads are sent to the solvent recovery facility 6.

In solvent recovery facility 6, which may be a conventional pipestill, a deasphalted tar fraction having, by way of example, a boiling point range of from about 550° F. to about 1000° F., is taken off as a sidestream 7 or bottoms product (not shown), depending on the operating conditions and design of the pipestill. Fluid is taken off as overheads and, as shown in FIG. 1, recycled through conduit 3.

Figure 2:
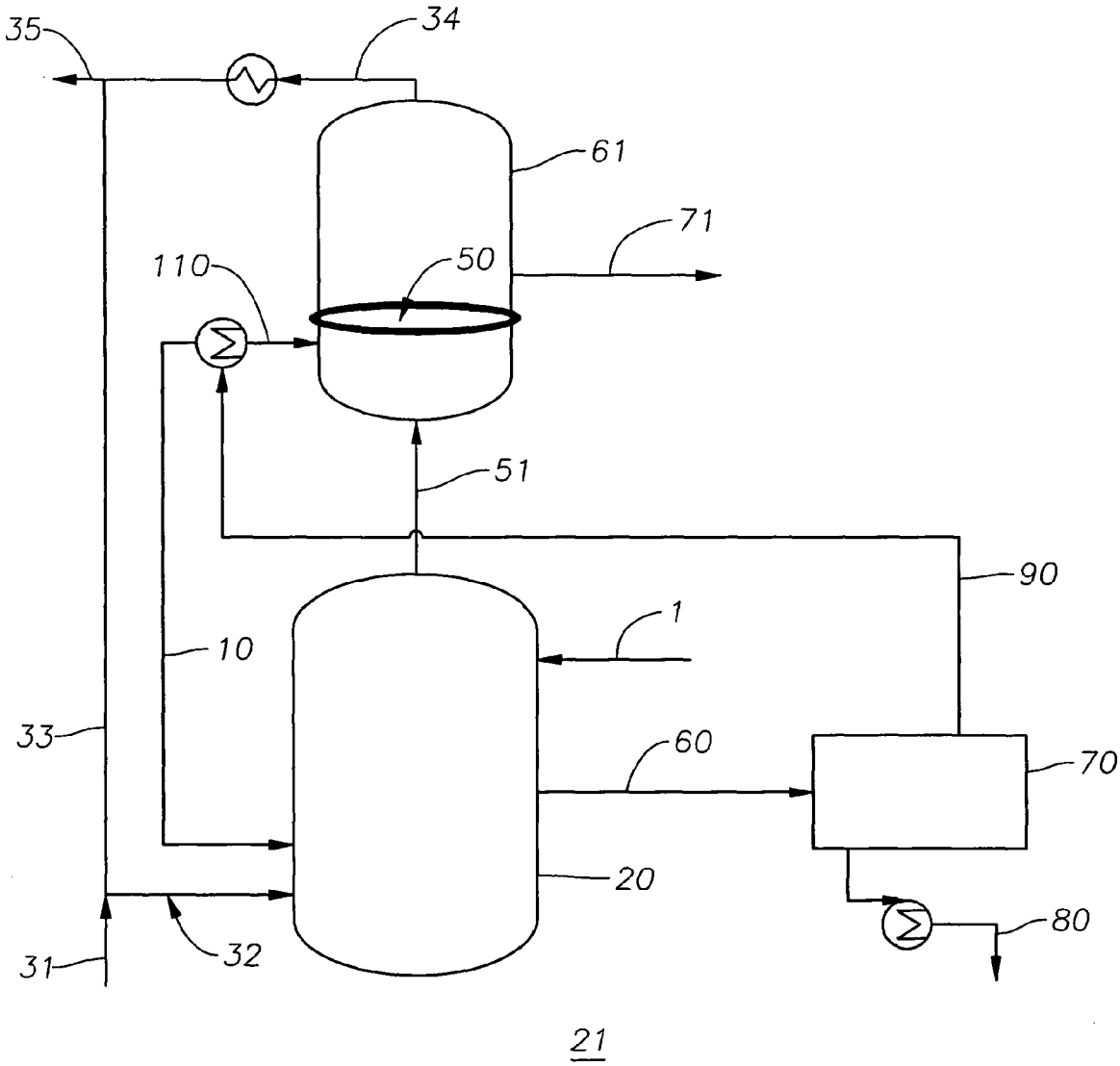
FIG. 2 is a process flow diagram illustrating a preferred embodiment of the present invention.

A more preferred embodiment is shown in FIG. 2, which is a simplified schematic flow diagram of a second embodiment of the invention. In this embodiment, the process for deasphalting tar, using the deasphalting system 21, is integrated with the front end of at least one pyrolysis furnace (not shown in the figure) so that at least a portion of the feedstream to the pyrolysis furnace is used as the fluid in the fluid or solvent deasphalter and, after recovery in the said recovery facilities, may then be sent to the pyrolysis furnace such as by rejoining the fluid with the feedstream to the pyrolysis furnace, as discussed with respect to FIG. 2, to generate, by way of example, light olefins.

In FIG. 2, a slipstream (or portion) is taken off in conduit 32 from a feedstream to one or more pyrolysis furnace(s) (not shown) fed by conduit 35, and used as solvent in the solvent deasphalter apparatus 20, also fed with the bottoms product comprising tar through conduit 1 (as in FIG. 1) from one or more primary fractionator downstream of one or more pyrolysis furnace(s), which may include the one or more pyrolysis furnaces fed by conduit 35 or may be one or more different pyrolysis furnaces, or any combination thereof. Typically the deasphalting apparatus of the present invention will be integrated with several furnaces at a fixed solvent to tar ratio of about 10:1.

As in the previous figure, solvent deasphalter 20 in FIG. 2 may be a conventional gravity settler type of deasphalter with conduit 51 representing the overflow of the portion of solvent with soluble portion of the tar and a bottoms conduit (not shown) for the heavy tar portion. However, in preferred optional embodiment mixing of solvent and tar occurs in vessel 20 and a deasphalted slurry mixture is taken through conduit 60 and allowed to gravity settle in a separate vessel 70, with the heavy tar portion taken off as bottoms through conduit 80 and solvent and soluble tar portion taken as overflow and sent to solvent recovery facilities 61. Take off of solvent through 51 and slurry through 70 may be used concurrently or intermittently.

Solvent recovery facility 61 may be a conventional distillation apparatus as in FIG. 1 or it may be an atmospheric or vacuum pipestill fitted with an annular entrainment device, as shown in FIG. 2.

As shown in FIG. 2, described in more detail below, the annular structure 50 defines a ceiling which blocks upward passage of vapor/liquid mixtures along the circular wall beyond the ceiling section, and surrounds an open core having sufficient cross-sectional area to permit vapor velocity low enough to avoid significant entrainment of liquid. The use of an annular entrainment device in a distillation tower has been described, for instance, in U.S. Pat. No. 4,140,212 and also U.S. Application Publication Nos. 20040004028; 20050261530; 20060089519; WO 2004005431; and 2005113715. The details not shown in FIG. 2, including trays, valves, and the like, would be immediately apparent to one of ordinary skill in the art in possession of the present invention.

As shown in FIG. 2, annular ring 50 is of a size and shape sufficient to decrease the entrainment of liquid in the overheads 34 (with optional heat exchange device shown by conventional symbol in line 34 prior to meeting line 35; such heat exchangers may be conveniently integrated with other chemical and/or refinery operations) and sidestream 71 compared with the pipestill 61 without the annular ring 50. As an example, using vacuum gas oil (VGO) as feed through conduit 32, a conventional pipestill fitted with annular ring 50 results in an overheads 34 having nil asphaltenes, and the sidestream 71 may have on the order of 100 ppm asphaltenes.

Although the overheads in conduit 34 will have essentially no asphaltenes with or without the ring insert 50, the ring insert 50 keeps the bottoms from creeping up the wall and entraining into the deasphalted side-stream draw 71.

The annular structure 50 blocks upward passage of vapor/liquid mixtures along the circular wall due to vapor velocity, and surrounds an open core having sufficient cross-sectional area to permit vapor velocity low enough to avoid significant entrainment of liquid. The annular entrainment ring 50 and/or ceiling structure may be maybe of the type described in U.S. Pat. No. 4,140,212 or U.S. Appl. Publication Nos. 20040004028, 20050261530, 20060089519; or WO 2004005431 or WO2005113715.

To further increase the removal efficiency of the non-volatile hydrocarbons in the flash drum, it is preferred that the overheads 90 from the deasphalted slurry settling vessel 70, if used, and or conduit 51, if used, enter the solvent recovery facility 61 tangentially through at least one tangential flash zone via inlet 110 below the annular ring 50, as shown in FIG. 2. The streams in 90 and 10 preferably but optionally meet at the unnumbered structure shown in FIG. 2 which is the conventional symbol for a heater, the heated mixture then entering vessel 61 via conduit 110. Such an optional feature is also shown in-line with conduit 80, discussed further below. Preferably, the tangential inlets are level or result in a slightly downward flow. The non-volatile hydrocarbon liquid phase will form an outer annular flow along the inside flash zone wall and the volatile vapor phase will initially form an inner core and then flow upwardly in the flash drum. The overheads from vessel 7, if used, may optionally be recycled through conduit 10 back to solvent deasphalter 20.

The solvent taken as overheads through conduit 34 may be partially or wholly sent to one or more pyrolysis furnace(s) (not shown) through conduit 35 or partially or wholly recycled (appropriate conduit not shown) to one or more solvent deasphalters. Typically, however, given a solvent:tar ratio on the order of 10:1, the output of solvent overhead from solvent recovery facilities 61 will be enough to feed several pyrolysis furnaces.

The heavy tar obtained as bottoms 4 in FIG. 1 or 80 (with or without the heater illustrated) in FIG. 2 is advantageously sent to a POX unit, used as coker feed for coking or mixed with distress heavy fuel oil. The POX and coker units are not shown in the figures and are not considered part of the embodiments shown in systems 11 or 21 of FIGS. 1 and 2, respectively. However, one or both apparatus may be considered part of embodiments of the invention.

The term "POX" means a partial oxidation and POX unit as used herein refers to the apparatus within which the partial oxidation occurs. The term "coking" or "delayed coking"

refers to a thermal cracking process by which a heavy material is converted into lighter material and coke, and the coking unit refers to the apparatus within which the coking occurs. Both process and apparatus terms are well known per se in refining.

In embodiments of the present invention, partial oxidation reacts the bottoms product from conduit 4 in FIG. 1 or 80 in FIG. 2 with oxygen at high temperatures to produce a mixture of hydrogen and carbon monoxide (Syn Gas). While the conditions of partial oxidation are not critical and can be determined by one of ordinary skill in the art, for the present invention preferred conditions include a temperature of about 1455° C. (±50° C.) and pressure of about 870 psig (±25 psig), measured at the reactor inlet. The $H_2$ and CO yields will vary according to conditions but in preferred embodiments will be in the range of about 0.98 to 1.8 $H_2$/CO, which may be achieved without undue experimentation by one of ordinary skill in the art in possession of the present disclosure. The Syn Gas is preferably used to make alcohols in integration with the well-known Oxo Process, or to make fuel, or to make a hydrogen rich product, or a combination of these uses.

In embodiments of the present invention, coking converts the hydrocarbon feed from the bottoms product in conduit 4 in FIG. 1 or 80 in FIG. 2 in the coker unit to coker naphtha and coker gas oil as overheads/sidestreams and coke as a bottoms product. In the present invention, the apparatus used may be a typical coker used in refinery processing, which in refining process converts residual oil from the crude unit vacuum or atmospheric column into gas oil. The process of coking or delayed coking is typically semi-continuous thermal cracking process which can be broken down to three distinct stages. The feed undergoes partial vaporization and mild cracking as it passes through the coking furnace. The vapours undergo cracking as they pass through the coke drum to fractionation facilities downstream. In a refinery the typical products of gas, naphtha, jet fuel and gas oil are separated in the fractionation facilities. According to the present invention, the products comprise coker naphtha and coker gas oil separated in the fractionation facilities; the petroleum coke remains in the drum. The heavy hydrocarbon liquid trapped in the coke drum is subjected to successive cracking and polymerization until it is converted to vapours and coke.

While appropriate coker conditions may be determined without undue experimentation by one of ordinary skill in the art in possession of the present disclosure, preferred conditions include a temperature of about 450 to 550° C. and pressure of about 15-25 psig, measured at the reactor inlet. Coke resulting from a low sulfur feed may be used for needle coke or anode coke. More generally, the coke produced by the process of the invention may be used for fuel.

The process of the invention, such as described with respect to systems 11 or 21 in FIGS. 1 and 2, respectively, may be batch, semi-continuous, or continuous.

The invention has been described above with reference to numerous embodiments and specific examples. Many variations will suggest themselves to those skilled in this art in light of the above detailed description. All such obvious variations are within the full intended scope of the appended claims. Particularly preferred embodiments include: a process comprising: (i) contacting a composition comprising tar and a solvent in a solvent deasphalter; (ii) mixing said tar with said solvent in said solvent deasphalter to produce a mixture comprising a first fraction comprising fluid and at least a portion of the tar that is relatively soluble in said fluid, and a second fraction comprising heavy tar that is relatively insoluble in said fluid; (iii) passing at least a portion of said first fraction to a solvent recovery apparatus and separating said first fraction into a solvent fraction and a deasphalted tar fraction in said solvent recovery apparatus; (iv) recovering said second fraction, said solvent fraction, and said deasphalted tar fraction; wherein said solvent is characterized as producing a product comprising tar and light olefins selected from the group consisting of ethylene, propylene, butenes, and mixtures thereof when steam cracked under suitable conditions; which may further be characterized by at least one of the following: said process further characterized by at least one of the following steps: (a) at least a portion of the solvent in step (i) is taken as a slipstream from a feedstream to at least one steam cracker, said at least one steam cracker producing, as a product of steam cracking said feedstream, tar and light olefins selected from the group consisting of ethylene, propylene, butenes and mixtures thereof; (b) at least a portion of the solvent fraction recovered in step (iv) is sent to at least one steam cracker and steam cracked to produce a product comprising tar and light olefins selected from the group consisting of ethylene, propylene, butenes, and mixtures thereof; the process wherein the tar in step (i) is at least a portion of the bottoms product of the primary fractionator downstream from the steam cracker in at least step selected from step (a) and step (b); wherein step (ii) includes the step of separating from said solvent deasphalter into a separate vessel a slurry comprising said first fraction and said second fraction, separating by gravity settling said first fraction and second fraction, taking said first fraction as overhead or overflow and passing said first fraction to step (iii) and taking said second fraction as bottoms product from said separate vessel; wherein said solvent recovery apparatus comprises a pipestill including a flash zone separated from a zone comprising distillation trays by at least one annular entrainment ring and obtaining as an overheads said solvent and as a sidestream above said at least one annular entrainment ring a deasphalted tar product; wherein said solvent is at least one solvent selected from the group consisting of butanes, LVN, FRN, HVN, Raffinate, and FNG; wherein at least a portion of said deasphalted tar fraction is mixed with bunker fuel oil and/or fuel oils lighter than bunker fuel oil; wherein at least a portion of said second fraction is passed to a POX unit and/or at least a portion of said second fraction is passed to a coker unit; wherein said deasphalted tar fraction recovered in step (iv) is at least 60 wt % of the tar contacted in step (i); and/or wherein said portion of said first fraction in step (iii) is heated prior to entering said solvent recovery apparatus.

Another preferred embodiment may be described in Jepson-style format, the preamble describing, for the purposes solely of this embodiment, acknowledged prior art, as follows: in a process for solvent deasphalting tar wherein tar is contacted with a solvent to yield a fraction comprising deasphalted tar and a fraction comprising heavy tar, the improvement comprising integrating said process with at least one pyrolysis furnace so that: (i) at least a portion of the feedstream to said at least one pyrolysis furnace provides the solvent contacting and deasphalting said tar; or (ii) said solvent, after separation from said fraction comprising deasphalted tar, provides at least a portion of the feedstream to said at least one pyrolysis furnace; or both (i) and (ii) are integrated into said process; this embodiment further modified by one or more of the following: wherein both (i) and (ii) are integrated into said process; wherein said solvent is selected from the group consisting of butanes, LVN, FRN, HVN, Raffinate, FNG, and mixtures thereof; wherein said solvent, after separation from said fraction comprising deasphalted tar, provides at least a portion of the feedstream to a plurality of pyrolysis furnaces; wherein the process is further integrated so that at least one pyrolysis furnace in step (i) and/or step (ii) provides at least a portion of the tar in step (i); wherein after deasphalting said tar, said fraction comprising deasphalted tar is taken off as an overhead or overflow slurry and sent to a solvent recovery apparatus and said fraction comprising heavy tar is recovered as bottoms product; wherein said fraction comprising deasphalted tar is separated from said heavy tar fraction in a vessel separate from the vessel wherein said tar is first contacted with said solvent; wherein at least a portion of said heavy tar fraction is further processed in a POX unit to produce syn gas, at least a portion of said heavy tar fraction is further processed in a coker to produce coker naphtha and coker gas oil, or a combination thereof; wherein said fraction comprising deasphalted tar is heated prior to entering a pipestill wherein said fraction comprising deasphalted tar is separated into at least one deasphalted tar stream and a solvent stream; wherein said at least deasphalted tar stream is recovered and mixed with a fuel oil pool without precipitation of asphaltenes; wherein said at least one deasphalted tar stream represents at least 60 wt % of the tar contacting said solvent in the solvent deasphalting apparatus; wherein said pipestill is equipped with an annular structure above the inlet where said fraction comprising deasphalted tar enters said pipestill, said annular structure defining a ceiling which blocks upward passage of vapor/liquid mixtures along the circular wall beyond the ceiling section, and surrounds an open core having sufficient cross-sectional area to permit vapor velocity low enough to avoid significant entrainment of liquid.

Yet another preferred embodiment is an apparatus comprising: (a) a steam cracker; (b) a solvent deasphalter; (c) and a solvent recovery vessel fluidly connected with said solvent deasphalter; wherein said steam cracker is fluidly connected with at least one of said solvent deasphalter and said solvent recovery vessel, whereby a feedstream to said steam cracker either provides feed to said solvent deasphalter or wherein said solvent recovery vessel provides feed to said steam cracker, or both; and a preferred embodiment wherein the solvent recovery vessel contains the annular ring described herein, such as a more preferred embodiment wherein said solvent recovery vessel contains an annular structure above an inlet providing fluid connection between said solvent recovery vessel and said solvent deasphalter, said annular structure defining a ceiling which blocks upward passage of vapor/liquid mixtures along a circular wall beyond the ceiling section, and surrounds an open core having sufficient cross-sectional area to permit vapor velocity low enough to avoid significant entrainment of liquid.

The meanings of terms used herein shall take their ordinary meaning in the art; reference shall be taken, in particular, to Handbook of Petroleum Refining Processes, Third Edition, Robert A. Meyers, Editor, McGraw-Hill (2004). All patents and patent applications, test procedures (such as ASTM methods, UL methods, and the like), and other documents cited herein are fully incorporated by reference to the extent such disclosure is not inconsistent with this invention and for all jurisdictions in which such incorporation is permitted. Trade names used herein are indicated by a ™ symbol or ® symbol, indicating that the names may be protected by certain trademark rights, e.g., they may be registered trademarks in various jurisdictions. When numerical lower limits and numerical upper limits are listed herein, ranges from any lower limit to any upper limit are contemplated.

What is claimed is:

1. A process comprising:

(i) contacting a composition comprising tar and a solvent in a solvent deasphalter;

(ii) mixing said tar with said solvent in said solvent deasphalter to produce a mixture comprising a first fraction comprising solvent and at least a portion of the tar that is relatively soluble in said solvent, and a second fraction comprising heavy tar that is relatively insoluble in said solvent;

(iii) passing at least a portion of said first fraction to a solvent recovery apparatus which comprises a pipestill including a flash zone separated from a zone comprising distillation trays by at least one annular entrainment ring and separating said first fraction into a solvent fraction and a deasphalted tar fraction in said solvent recovery apparatus;

(iv) recovering said second fraction, said solvent fraction, and said deasphalted tar fraction, wherein the solvent fraction is obtained as overheads from the pipestill and a sidestream taken above said at least one annular entrainment ring provides the tar fraction deasphalted to contain from 0 to 100 ppm asphaltenes;

wherein said solvent is characterized as producing a product comprising tar and light olefins selected from the group consisting of ethylene, propylene, butenes, and mixtures thereof when steam cracked under suitable conditions.

2. The process of claim 1, said process further characterized by at least one of the following steps:

(a) at least a portion of the solvent in step (i) is taken as a slipstream from a feedstream to at least one steam cracker, said at least one steam cracker producing, as a product of steam cracking said feedstream, tar and light olefins selected from the group consisting of ethylene, propylene, butenes and mixtures thereof (b) at least a portion of the solvent fraction recovered in step (iv) is sent to at least one steam cracker and steam cracked to produce a product comprising tar and light olefins selected from the group consisting of ethylene, propylene, butenes, and mixtures thereof.

3. The process of claim 2, wherein the tar in step (i) is at least a portion of the bottoms product of a primary fractionator downstream from the steam cracker in at least one step selected from step (a) and step (b).

4. The process of claim 1, wherein step (ii) includes the step of separating from said solvent deasphalter into a separate vessel a slurry comprising said first fraction and said second fraction, separating by gravity settling said first fraction and second fraction, taking said first fraction as overhead or overflow and passing said first fraction to step (iii) and taking said second fraction as bottoms product from said separate vessel.

5. The process of claim 1, wherein said solvent is at least one solvent selected from the group consisting of butanes, LVN, FRN, HVN, Raffinate, and FNG.

6. The process of claim 1, wherein at least a portion of said deasphalted tar fraction is mixed with bunker fuel oil and/or fuel oils lighter than bunker fuel oil.

7. The process of claim 1, wherein at least a portion of said second fraction is passed to a POX unit and/or at least a portion of said second fraction is passed to a coker unit.

8. The process of claim 1, wherein said deasphalted tar fraction recovered in step (iv) is at least 60 wt % of the tar contacted in step (i).

9. The process of claim 1, wherein said portion of said first fraction in step (iii) is heated prior to entering said solvent recovery apparatus.

10. In a process for solvent deasphalting tar wherein tar is contacted with a solvent to yield a fraction comprising deasphalted tar and a fraction comprising heavy tar, the improvement comprising integrating said process with at least one pyrolysis furnace so that: (i) at least a portion of the feedstream to said at least one pyrolysis furnace provides the solvent contacting and deasphalting said tar; or (ii) said solvent, after separation from said fraction comprising deasphalted tar, provides at least a portion of the feedstream to said at least one pyrolysis furnace; or both (i) and (ii) are integrated into said process; and further, wherein said fraction comprising deasphalted tar is heated prior to entering a pipestill wherein said fraction comprising deasphalted tar is separated into at least one deasphalted tar stream and a solvent stream, said pipestill being equipped with an annular structure above an inlet where said fraction comprising deasphalted tar enters said pipestill, said annular structure defining a ceiling which blocks upward passage of vapor/liquid mixtures along the circular wall beyond the ceiling section, and surrounds an open core having sufficient cross-sectional area to permit vapor velocity low enough to avoid significant entrainment of liquid, and taking a sidestream from above the annular structure to provide a deasphalted tar product containing from 0 to 100 ppm asphaltenes.

11. The process of claim 10, wherein both (i) and (ii) are integrated into said process.

12. The process of claim 10, wherein said solvent is selected from the group consisting of butanes, LVN, FRN, HVN, Raffinate, FNG, and mixtures thereof

13. The process of claim 10, wherein said solvent, after separation from said fraction comprising deasphalted tar, provides at least a portion of the feedstream to a plurality of pyrolysis furnaces.

14. The process of claim 10, wherein the process is further integrated so that at least one pyrolysis furnace in step (i) and/or step (ii) provides at least a portion of the tar in step (i).

15. The process of claim 10, wherein after deasphalting said tar, said fraction comprising deasphalted tar is taken off as an overhead or overflow slurry and sent to a solvent recovery apparatus and said fraction comprising heavy tar is recovered as bottoms product.

16. The process of claim 10, wherein said fraction comprising deasphalted tar is separated from said heavy tar fraction in a vessel separate from the vessel wherein said tar is first contacted with said solvent.

17. The process of claim 15, wherein at least a portion of said heavy tar fraction is further processed in a POX unit to produce syn gas, at least a portion of said heavy tar fraction is further processed in a coker to produce coker naphtha and coker gas oil, or a combination thereof.

18. The process of claim 10, wherein said at least deasphalted tar stream is recovered and mixed with a fuel oil pool without precipitation of asphaltenes.

19. The process of claim 10, wherein said at least one deasphalted tar stream represents at least 60 wt % of the tar contacting said solvent in the solvent deasphalting apparatus.

* * * * *